United States Patent [19]

Shienfeld

[11] Patent Number: 4,762,121

[45] Date of Patent: Aug. 9, 1988

[54] MASSAGING SLEEVE FOR BODY LIMBS

[75] Inventor: Izhar Shienfeld, Afek, Israel

[73] Assignee: Mego Afek, Industrial Measuring Instruments, Afek, Israel

[21] Appl. No.: 402,900

[22] Filed: Jul. 29, 1982

[30] Foreign Application Priority Data

Aug. 14, 1981 [IL] Israel ..... 63574

[51] Int. Cl.[4] ..... A61H 9/00

[52] U.S. Cl. ..... 128/64; 128/24 R

[58] Field of Search ..... 128/24 R, 38–40, 128/64

[56] References Cited

U.S. PATENT DOCUMENTS

| | | | |
|---|---|---|---|
| 1,608,239 | 11/1926 | Rosett | 128/64 X |
| 1,646,590 | 10/1927 | Mildenberg | 128/64 |
| 3,659,593 | 5/1972 | Vail | 128/64 |
| 3,862,629 | 1/1975 | Rotta | 128/24 R |
| 3,866,604 | 2/1975 | Curless et al. | 128/64 |
| 4,013,069 | 3/1977 | Hasty | 128/24 R |
| 4,066,084 | 1/1978 | Tillander | 128/64 X |
| 4,202,325 | 5/1980 | Villari et al. | 128/24 R |
| 4,338,923 | 7/1983 | Gelfer et al. | 128/24 R |

FOREIGN PATENT DOCUMENTS

| | | | |
|---|---|---|---|
| 498004 | 3/1976 | U.S.S.R. | 128/64 |

*Primary Examiner*—Richard J. Apley
*Assistant Examiner*—J. Welsh
*Attorney, Agent, or Firm*—Benjamin J. Barish

[57] ABSTRACT

A massaging sleeve for massaging body limbs comprises a plurality of inflatable cells in the form of inflatable bags individually received in compartments produced in a flexible covering adapted to be laid relatively flat and rolled into the shape of a sleeve. The cells are in a partially-overlapping relationship such that the outermost cell, which is inflated first, anchors that end of the sleeve to the body limb, while the subsequent inflation of the remaining cells in sequence tends to move the sleeve in the longitudinal direction such as to obviate the need for a shoulder harness. The inner end of the sleeve is formed with substantially rigid elements curved to conform to the curvature of the user's shoulder.

8 Claims, 3 Drawing Sheets

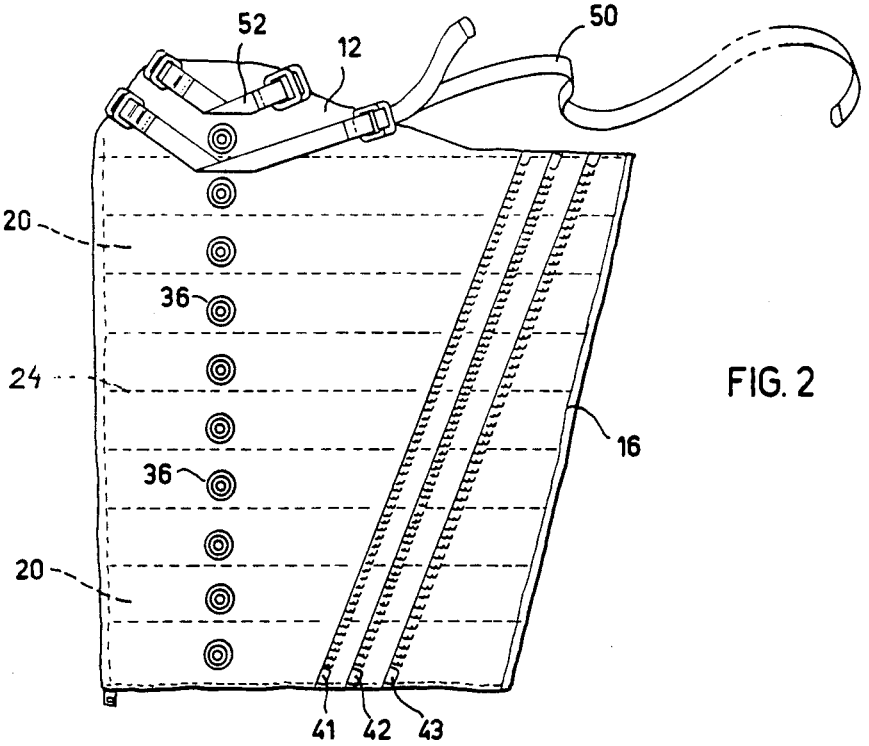
FIG. 2
FIG. 4
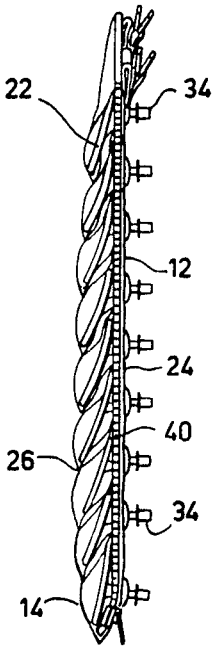
FIG. 3
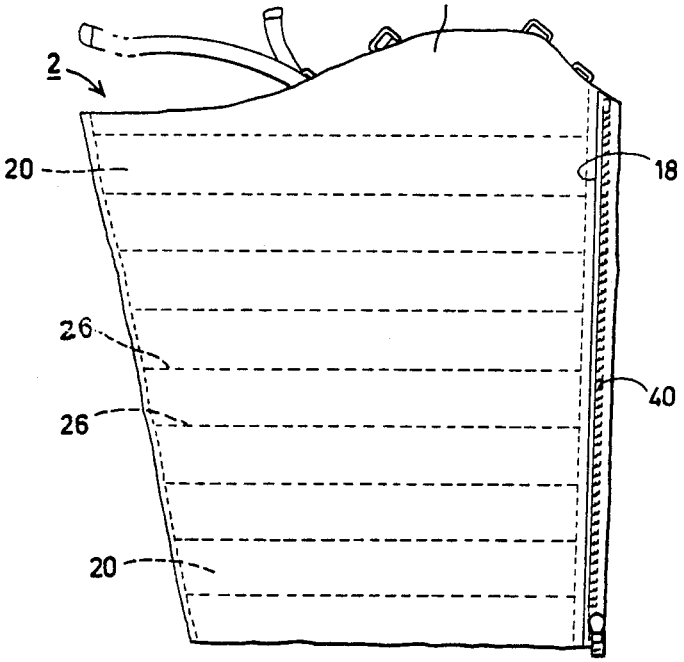

FIG. 7
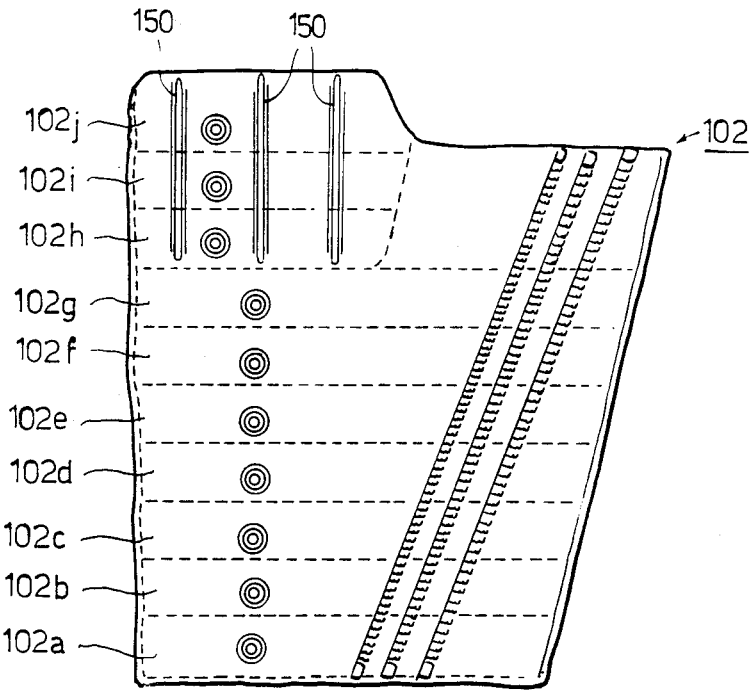
FIG. 8
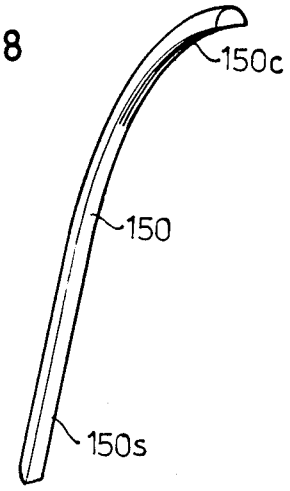
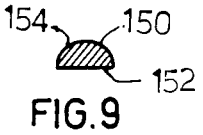
FIG.9
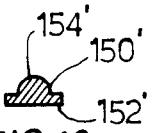
FIG.10

MASSAGING SLEEVE FOR BODY LIMBS

BACKGROUND OF THE INVENTION

The present invention relates to a device for massaging the limbs of a body, and particularly to a massaging sleeve formed with a plurality of cells which are inflatable and deflatable to apply a squeezing pressure to the body limb for treating same against a number of medical disorders. The invention is particularly useful in the treatment of lymphatic disorders, such as congenital or secondary lymphedema in order to reduce excessive accumulation of fluids in the body tissue. Other possible applications of the invention are in the treatment of venous disorders, such as painful varicose veins, chronic venous insufficiency, and ulcus cruris. Still further possible applications are in the treatment of paralysis of the lower limbs because of long-standing muscular inactivity, and in the prevention of deep vein thrombosis during and after surgical operations.

It has been found that beneficial results can be obtained in treating for the above disorders by sequentially compressing successive portions of the afflicted limb to produce a massaging or pumping action towards the heart. A number of techniques and apparatus have been devised for this purpose, in which the limb is massaged by means of a sleeve including a plurality of cells extending along the length of the sleeve, which cells are inflatable and deflatable to apply squeezing pressures to the limb. Examples of known devices for this purpose are described in U.S. Pat. Nos. 4,156,425; 4,013,069; and 2,781,041; in French Pat. Nos. 1,175,948 and 2,246,260; and also in U.S. patent application No. 945,796 filed Sept. 26, 1978, now U.S. Pat. No. 4,338,923 assigned to the same assignee as the present invention. In some of these known constructions, the inflatable cells are usually constructed as an integral unit either in sleeve form to enclose the limb, or in a relatively flat form to be wrapped into a sleeve and then to enclose the limb. Such known arrangements, however, wherein the inflatable cells are formed as an integral unit, produce repair and maintenance problems, since the repair or replacement of any one cell requires that the whole unit must be removed and repaired or replaced. Another known construction, illustrated for example in French Pat. No. 1,175,948, includes individually-formed cells, but these are attached to a single supporting sheet, such that each cell must be constructed sufficiently strong to withstand the high pressure applied to it when inflated. Moreover, in this arrangement the massaging sleeve is inconvenient and difficult to apply, remove, use and also to store during non-use.

Another drawback in some of the known massaging sleeves is that they require a shoulder harness, when the massaging sleeve is applied to the arm of the user, in order to support the massaging sleeve in place. Such a shoulder harness may be a source of considerable discomfort to the user.

An object of the present invention is to provide a massaging sleeve of the foregoing type having advantages in the above respects.

SUMMARY OF THE INVENTION

According to a broad aspect of the present invention, there is provided a novel massaging sleeve formed with a plurality of cells extending along the length of the sleeve which cells are inflatable and deflatable to apply a squeezing pressure to a body limb when enclosed by the sleeve. The sleeve comprises an outer flexible covering adapted to be laid relatively flat and rolled into the shape of a sleeve to enclose the limb. The outer flexible covering includes a first panel of flexible sheet material forming one face of the covering, a second panel of flexible sheet material forming the opposite face of the covering, and a plurality of divider panels of flexible sheet material secured to the first and second panels along lines extending transversely thereof and dividing the space therebetween into a plurality of individual compartments each extending substantially the complete width of the first and second panels. The first and second panels are secured together along all their edges except for one longitudinal edge such that one edge of each of the compartments is open. In addition, the first panel is formed with a plurality of openings therethrough, one for each of the compartments.

The sleeve further comprises a plurality of individual, inflatable bags each receivable in one of the compartments through the open end thereof and of a length extending substantially the complete width of the outer flexible covering. Each of the bags includes a port connector extending through the opening of its respective compartment for inflating and deflating the bag.

According to another feature of the invention, the outermost cell, at the end of the sleeve to be inflated first, is disposed so as to engage the body limb for substantially the complete width of the cell, the remaining cells being in partially overlapping relation to said outermost cell and to each other, with the outer end of each such remaining cell overlying the inner end of the adjacent cell, such that the inflation of the outermost cell anchors that end of the massaging sleeve to the body limb, while the subsequent inflation of the remaining cells in sequence from the outermost end to the innermost end of the sleeve causes such cells to apply a force tending to move the overall sleeve in the longitudinal direction from the end of the outermost cell towards the end of the innermost cell.

According to a still further feature, the massaging sleeve further includes one or more substantially rigid elements extending transversely across the plurality of cells at the innermost end of the sleeve, which substantially rigid elements are curved at the innermost end of the sleeve to conform to the curvature of the user's shoulder.

A massaging sleeve constructed in accordance with the foregoing features provides a number of advantages over the above-mentioned known devices. Thus, if any cell ruptures or otherwise has to be repaired, it is only necessary to remove that one bag and repair or replace it, rather than to repair or replace the complete unit. Such arrangement also substantially reduces the maintenance problems, since it is only necessary to stock the various-sized bags for individual replacement whenever needed. In addition, the outer flexible covering defining separate compartments provides a very neat, compact, and secure carrier for the individual inflatable bags, such that the massage sleeve may be applied, removed, used and stored in a simple and convenient manner. Moreover, disposing the inflatable bags within individual compartments formed in the flexible outer covering provides the bags with substantial mechanical support to withstand the high pressure during inflation, so that relatively thin, pliable material may be used for these bags.

In addition, by providing the specified overlapping relationship of the cells, a force is produced tending to move the sleeve longitudinally in the direction of its outermost end to its innermost end during the sequential inflation of the cells, which thereby obviates the need for a shoulder harness, and therefore avoids the discomfort that such a shoulder harness frequently causes. In addition, providing the rigid elements at the innermost end of the sleeve extending transversely across the uppermost cells causes the massaging sleeve also to apply a squeezing pressure to the upper shoulder region of the user, which has been found to produce significant beneficial results in many applications of the massaging sleeve.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a side elevational view illustrating the sleeve of FIG. 1 but in its flat form;

FIG. 3 is a view similar to that of FIG. 2 but illustrating the opposite side of the massaging sleeve in its flat form;

FIG. 4 is an end view of the sleeve of FIGS. 2 and 3 in its flat form;

FIG. 7 is a view similar to that of FIG. 2, but illustrating a modification;

FIG. 8 is a three-dimensional view illustrating one of the rigidifying elements in the modification of FIG. 7; and FIGS. 9 and 10 illustrate two examples of the cross-sectional configuration that each of the rigidifying elements illustrated in FIG. 8 may take.

DESCRIPTION OF PREFERRED EMBODIMENTS

Figure 1:
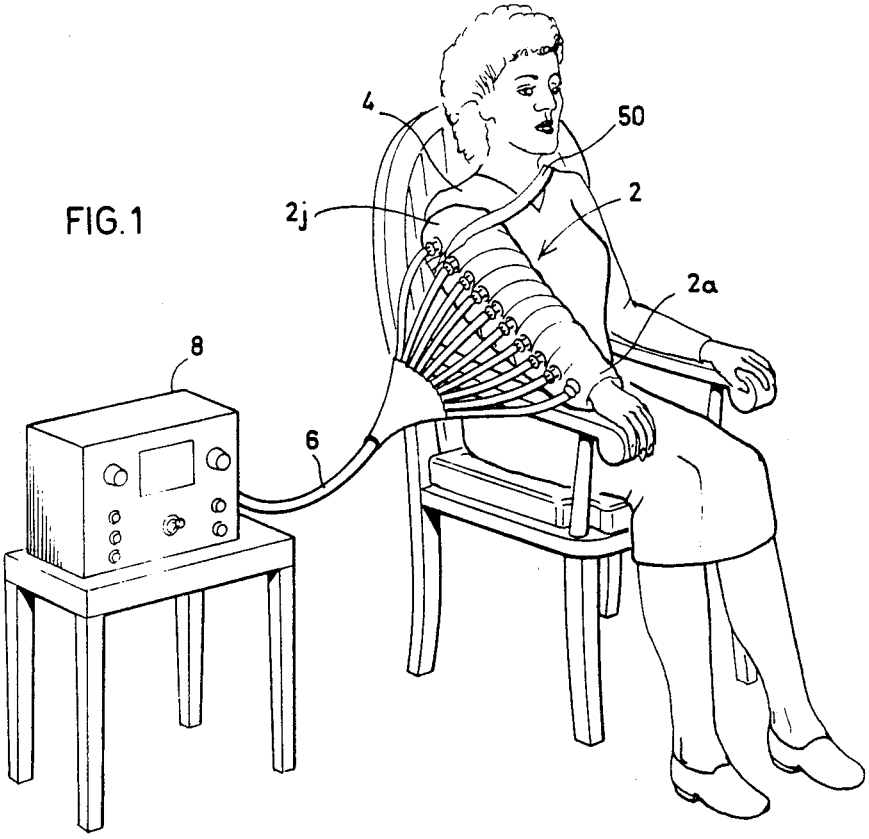
FIG. 1 illustrates one form of massaging sleeve constructed in accordance with the present invention, and its manner of use for massaging the arm of a person.

With reference first to FIG. 1, there is illustrated a massaging sleeve, generally designated 2, applied to the arm of a subject 4, e.g. for treating one of the disorders mentioned earlier. The massaging sleeve 2 is formed with a plurality of cells extending along the length of the sleeve, which cells are inflatable and deflatable to apply a squeezing or massaging pressure to the arm. In the example illustrated, the sleeve 2 includes 10 such inflatable cells, designated *2a–2j*. These cells are individually inflated and deflated by means of a plurality of tubes, generally designated 6, connected to control apparatus 8 for sequentially applying and releasing pressurized fluid with respect to these cells.

The construction of the massage sleeve 2 is better illustrated in FIGS. 2–5. Briefly, the sleeve includes an outer flexible covering of a material adapted to be laid relatively flat as shown in FIGS. 2 and 3, or rolled into a tubular shape as shown in FIG. 1. The outer flexible covering is formed with a plurality of individual compartments each adapted to receive an inflatable bag such that when the sleeve is applied to the subject's arm during use, as shown in FIG. 1, each bag encircles a portion of the arm.

More particularly, the flexible outer covering of the sleeve is made of sheet material defining a first panel 12 (FIG. 2) forming one face of the flexible covering, and second panel 14 (FIG. 3) forming the opposite face of the flexible covering. The two panels are joined together, as by stitching, along the top and bottom transverse edges, but only along one longitudinal edge as shown at 16 in FIGS. 2 and 3, defining the length of the sleeve when rolled in its tubular or sleeve form. The two panels are unjoined at their opposite edge, as shown by the solid line 18 in FIG. 3, to permit access between the two panels as will be described more particularly below.

The individual compartments, generally indicated 20 in FIGS. 2 and 3, are formed between the two flexible sheets 12 and 14 be securing a plurality of divider panels 22 between the two sheets. Thus, as shown particularly in FIGS. 4 and 5, each divider panel 22 is attached, as by stitching, along one edge (e.g. its upper edge as shown in FIGS. 3 and 4) to one of the face panels along a first line 24 extending width-wise i.e., transversely, of the flattened sleeve (which will be circumferentially of the sleeve when in its tubular form), and along its opposite edge to the outer face panel along a second line 26 extending parallel to but spaced from the first line 24. Thus, each of the divider panels 22 extends at a bias or angle with respect to the face panels 12 and 14, so that the individual compartments 20 defined by them would be in partially overlapping relationship.

Figure 6:
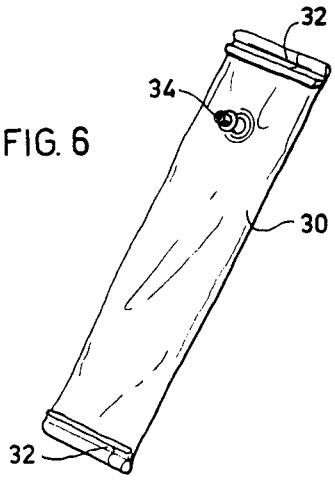
FIG. 6 illustrates one of the inflatable bags included in the massaging sleeve of FIGS. 1–5.
Figure 5:
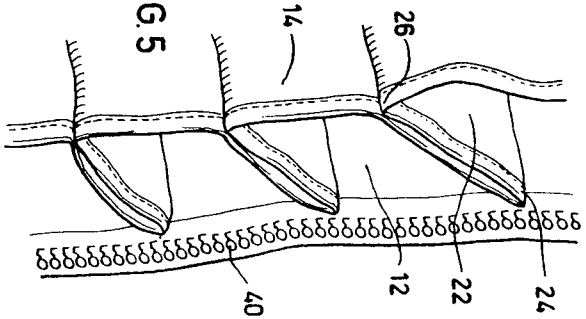
FIG. 5 is an enlarged fragmentary view of a portion of the end of the sleeve of FIG. 4 to better show its internal structure.

Each of the compartments 20 is adapted to receive an inflatable bag 30, illustrated in FIG. 6. Bag 30 is made of pliable plastic sheet material rolled into tubular form and sealed at its opposite ends 32 so as to be substantially flat when in its deflated condition, but to approach a cylindrical configuration in its inflated condition. Each inflatable bag 30 is provided with a port connector 34 adapted to be received within an opening reinforced by a grommet 36 in panel 12 of the outer flexible covering. As shown particularly in FIG. 2, all these openings are arranged in a line to facilitate their connection to the respective one of the fluid pressure tubes 6 (FIG. 1) which apply the pressurized fluid to the inflatable bags 30.

The illustrated device is retained in its sleeve or tubular form by a first zipper strip 40 extending along one edge, preferably the open edge, which zipper strip may be selectively attached to one of a plurality (three being illustrated) of zipper strips 41, 42, 43 (FIG. 2) extending at an angle adjacent to the opposite edge. Thus, the device may be formed as a sleeve of the required diameter (three diameters being possible in the device illustrated) by merely applying zipper strip 40 to the selected zipper strip 41, 42 or 43.

Finally, the illustrated device includes straps 50 and 52 to facilitate wearing of the sleeve on the arm during use, as shown in FIG. 1.

The manner of using the device will be apparent from the above description. First, the device is assembled with the inflatable bags 30 by inserting each bag into its respective compartment 20 through the open end 18 of the flexible covering (panels 12, 14) in its flat condition. A sleeve of the required diameter may then be formed by merely attaching zipper strip 40 to the selected strip 41, 42 or 43, and is applied to the subject's arm with a snug fit as shown in FIG. 1, the sleeve being comfortably retained on the arm by the use of the straps 50 and 52. The tubes 4 may then be connected to the projecting connecting ports 34 of the individual inflatable bags 30 to supply the pressurized fluid to the individual bags 30 within the compartments of the sleeve.

The device 6 for supplying the pressurized fluid would include various presetting means, as shown by the front panel of the device in FIG. 1, for determining the pressure of the fluid, and the cycles of operation, to be applied to the individual cells of the sleeve to produce the desired massaging effect.

It will be appreciated that the above-described construction for the sleeve enables each cell, particularly the inflatable bags 30, to be individually repaired or replaced if necessary, without requiring the removal, repair or replacement of the complete unit of inflatable cells. Moreover, the outer flexible covering formed with the separate compartments for individually receiving the inflatable bags, not only provides a convenient and simple arrangement for applying, removing and using the massaging sleeve, but also provides mechanical support for the bags during their inflation so that they may be constructed of relatively thin pliable plastic material. This reduces the cost of manufacture of the massaging sleeve, and also reduces its weight so as to make it more comfortable to wear. Manufacturing the cells as individual bags, rather than as an integral, multicell unit, also significantly lowers the cost of manufacture of the device, and further simplifies its maintenance, since it is only necessary to stock a plurality of the individual bags of the required sizes.

FIGS. 7–10 illustrate a modification in the massaging sleeve, therein designated 102.

Thus, it was found that when the massaging sleeve was constructed with the overlapping-cell arrangement as particularly illustrated in FIG. 4, the shoulder harness 50 (FIGS. 1 and 2) could be omitted. That is to say, in this arrangement the outermost cell 102*a* is inflated first, and is disposed so as to engage the body limb for substantially the complete width of the cell, the remaining cells 102*b*–102*j* being in partially overlapping relation to the end cell and to each other such that the outer end of each such remaining cell overlies the inner end of the adjacent cell. It was found that in such a construction, the inflation of the outermost cell 102*a*, which was inflated first, anchored that end of the massaging sleeve to the body limb, while the subsequent inflation of the remaining cells in sequence caused those cells to apply a force tending to move the overall sleeve along the arm in the longitudinal direction from the outermost end to the innermost end, i.e., from the hand to the shoulder in the illustration of FIG. 1. It was therefore seen that such an arrangement obviated the need for the shoulder harness 50 illustrated in FIGS. 1 and 2, and therefore avoided the discomfort that the use of such a shoulder harness may cause in many applications of the illustrated massaging sleeve.

Accordingly, the massaging sleeve 102 illustrated in FIG. 7 is constructed in the same cell overlapping relationship as in the massaging sleeve of FIGS. 1–6, as particularly illustrated in FIG. 4, except that it does not includes the shoulder harness 50.

Another change in the massaging sleeve illustrated in FIG. 7 is that it includes a plurality of spaced, substantially rigid elements, therein designated 150, extending transversely across a plurality of the cells at the innermost end of the sleeve. In this case, there are three such rigid elements 150 extending transversely across the three innermost cells, namely, cells 102*h*–102*j* of the massaging sleeve. As shown particularly in FIG. 8, each of the rigid elements 150 includes a straight portion 150*s* extending transversely across cells 102*h* and 102*i*, and a curved portion 150*c* extending transversely across the innermost cell 102*j*. The curvature of portion 150*c* substantially conforms to the curvature of the user's shoulder. This innermost cell 102*j*, together with the underlying curved portions 150*c* of the rigid elements 150, not only more securely holds the massaging sleeve in place without the harness, but also applies a squeezing pressure to the upper shoulder region of the user, which has been found to be very beneficial in many applications of the massaging sleeve.

Preferably, the rigidifying elements 150 have a flat inner face, as shown at 152 in FIG. 9, to provide a relatively large surface area for distributing the pressure to the shoulder region of the user. The outer face 154 of each rigid element 150 may be curved, as shown by the convex curvature in FIG. 9. These elements may be of plastic, metal (e.g., aluminum) or other material suitable to increase the rigidity of the upper portion of the sleeve.

FIG. 10 illustrates an alternative cross-sectional configuration for each of the rigidifying elements, therein designated 150′, in which its inner face 152′ is flat, and its outer face includes a convex configuration only along its central area 154′.

While the described preferred embodiments illustrate ten inflatable cells, it will be appreciated that other numbers may be used, e.g. twelve. Also, in the preferred embodiments the inflating fluid is air, but other fluids, e.g. water, could be used.

Other variations, modifications and applications of the invention will be apparent.

What is claimed is:

1. A massaging sleeve formed with a plurality of cells extending along the length of the sleeve which cells are inflatable and deflatable to apply a squeezing pressure to a body limb when enclosed by the sleeve; said sleeve comprising an outer flexible covering adapted to be laid relatively flat and rolled into the shape of a sleeve to enclose the limb, and including:

a first panel of flexible sheet material forming one face of the covering, a second panel of flexible sheet material forming the opposite face of the covering, a plurality of divider panels of flexible sheet material secured to said first and second panels along lines extending transversely thereof and dividing the space therebetween into a plurality of individual compartments each extending substantially the complete width of said first and second panels, said first and second panels being secured together along all their edges except for one longitudinal edge such that one end of each of said compartments is open, said first panel being formed with a plurality of openings therethrough, one for each of said compartments;

said sleeve further comprising a plurality of inflatable bags each individually receivable in and removable from one of said compartments through the open end thereof, and being of a length extending substantially the complete width of said outer flexible covering; each of said bags including a port connector extending through the opening of its respective compartment for inflating and deflating the bag.

2. The massaging sleeve according to claim 1, wherein each of said plurality of divider panels is secured along one edge to one of said face panels along a first line, and along its opposite edge to the second face panel along a second line parallel to but spaced from said first line, such that said divider panels define individual compartments in partially overlapping relationship with respect to each other.

3. The massaging sleeve according to claim 1, wherein all said bags, when deflated, are of substantially rectangular configuration and of substantially the same width but of decreasing length from one end of the sleeve to the opposite end.

4. The massaging sleeve according to claim 1, wherein said outer flexible covering includes a zipper strip at one end attachable to a selected one of a plurality of zipper strips adjacent to the opposite end for forming sleeves of different diameters.

5. The massaging sleeve according to claim 1, wherein the outermost cell, at the end of the sleeve to be inflated first, is disposed so as to engage the body limb for substantially the complete width of the cell, the remaining cells being in partially overlapping relation to said outermost cell and to each other, with the outer end of each such remaining cell overlying the inner end of the adjacent cell, such that the inflation of the outermost cell bag anchors that end of the massaging sleeve to the body limb, while the subsequent inflation of the remaining cells in sequence from the outermost end to the innermost end of the sleeve causes such cell bags to apply a force tending to move the overall sleeve in the longitudinal direction from the end of the outermost cell towards the end of the innermost cell.

6. The massaging sleeve according to claim 1, further including one or more substantially rigid elements extending transversely across the plurality of cells at the innermost end of the sleeve, which substantially rigid elements are curved at the innermost end of the sleeve to conform to the curvature of the user's shoulder.

7. The massaging sleeve according to claim 6, wherein the innermost end of the sleeve aligned with the curved portion of the rigid element includes one of said cells for applying a squeezing pressure to the upper shoulder region of the user.

8. The massaging sleeve according to claim 7, wherein said substantially rigid elements are in the form of spaced rods each having an inner flat face.

* * * * *